US009824641B2

(12) United States Patent
Miyazaki et al.

(10) Patent No.: US 9,824,641 B2
(45) Date of Patent: Nov. 21, 2017

(54) METHOD OF DRIVING ELECTROPHORESIS DISPLAY DEVICE BASED ON ELECTROPHORETIC PARTICLE MIGRATION SPEEDS, ELECTROPHORESIS DISPLAY DEVICE, AND ELECTRONIC APPARATUS

(75) Inventors: Atsushi Miyazaki, Suwa (JP); Kazuki Imai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 13/088,544

(22) Filed: Apr. 18, 2011

(65) Prior Publication Data

US 2011/0261035 A1 Oct. 27, 2011

(30) Foreign Application Priority Data

Apr. 23, 2010 (JP) ..... 2010-100019

(51) Int. Cl.
*G09G 3/34* (2006.01)
*G09G 3/20* (2006.01)

(52) U.S. Cl.
CPC ..... *G09G 3/344* (2013.01); *G09G 3/207* (2013.01); *G09G 2300/0857* (2013.01)

(58) Field of Classification Search
CPC . G09G 3/207; G09G 3/344; G09G 2300/0857
USPC ..... 345/84, 107, 204–205; 359/296
See application file for complete search history.

(56) References Cited

U.S. PATENT DOCUMENTS

2007/0171187 A1* 7/2007 Saito ..... 345/107
2007/0247417 A1* 10/2007 Miyazaki et al. ..... 345/107
2008/0048970 A1* 2/2008 Drzaic et al. ..... 345/107
2008/0204399 A1* 8/2008 Choi et al. ..... 345/107
2009/0058798 A1 3/2009 Miyazaki
2009/0146991 A1* 6/2009 Shimodaira et al. ..... 345/214
2010/0201657 A1 8/2010 Miyazaki
2010/0315391 A1* 12/2010 Kokeguchi ..... 345/205

FOREIGN PATENT DOCUMENTS

JP 52-70791 A 6/1977
JP 58-143389 A 8/1983
JP 2007-206266 A 8/2007
JP 2009-58801 A 3/2009
JP 2010-204629 9/2010
JP 2010-211048 A 9/2010
JP 2010-211049 A 9/2010

* cited by examiner

*Primary Examiner* — Lisa Landis

(74) *Attorney, Agent, or Firm* — ALG Intellectual Property, LLC

(57) ABSTRACT

There is disclosed a method of driving an electrophoresis display device including a display unit having a plurality of pixel electrodes, a common electrode opposite to the plurality of pixel electrodes, and a first and second electrophoresis particles that are disposed between the plurality of pixel electrodes and the common electrode, the method including applying a first or second potential to each of the pixel electrodes, and applying the first or second potential, which is periodically switched, to the common electrode, when an image displayed on the display unit is rewritten, wherein, when the first and second potentials are periodically applied to the common electrode, the application of the first potential for a first application time and the application of the second potential for a second application time different from the first application time are repeatedly performed.

6 Claims, 10 Drawing Sheets

B
DG
LG
W

B
B
W
W
IMAGE DATA : 0 0 1 1
PIXEL ELECTRODE : High High Low Low

B
DG
W
W
0 1 0 0
Hi-Z Low Hi-Z Hi-Z

B
DG
LG
W
0 0 1 0
Hi-Z Hi-Z High Hi-Z

DG
DG
W
W
IMAGE DATA : 0 0 1 1
PIXEL ELECTRODE 24 : High High Low Low
POTENTIAL S1 = "High" LEVEL
POTENTIAL S2 = "Low" LEVEL B
DG
LG
W
0 1 0 1
High Hi-Z High Hi-Z
POTENTIAL S1 = "High" LEVEL
POTENTIAL S2 = HIGH IMPEDANCE STATE (Hi-Z)

METHOD OF DRIVING ELECTROPHORESIS DISPLAY DEVICE BASED ON ELECTROPHORETIC PARTICLE MIGRATION SPEEDS, ELECTROPHORESIS DISPLAY DEVICE, AND ELECTRONIC APPARATUS

BACKGROUND

1. Technical Field

The present invention relates to a method of driving an electrophoresis display device, an electrophoresis display device, and an electronic apparatus.

2. Related Art

When an electric field is applied to a dispersion solution that is obtained by dispersing electrophoresis particles in a solution, a phenomenon (electrophoresis phenomenon) where the electrophoresis particles migrate due to a Coulomb force is generated. An electrophoresis display device such as a piece of electronic paper using the electrophoresis phenomenon has been developed.

Each of the electrophoresis display devices includes pixel electrode provided for each of a plurality of pixels and a common electrode that is commonly provided opposite to the plurality of pixel electrodes and is driven to make the electrophoresis particles migrate by using an electric field generated by a potential difference between the pixel electrodes and the common electrode. In the electrophoresis display device, a state where the electrophoresis particles migrate by the driving method described above is displayed as a display image.

In addition, as a representative driving method in a display device such as a liquid crystal display, a driving method so-called "common oscillation driving" where a potential of each of the pixel electrode is switched and a potential of the common electrode is also switched is known. In addition, a technique for applying the common oscillation driving to the electrophoresis display device has been suggested (see, JP-A-52-70791).

According to the technique disclosed in JP-A-52-70791, by the common oscillation driving, the potential of the pixel electrodes and the common electrode can be controlled in two values that are a high potential and a low potential, and thereby voltage reduction of the electrophoresis display device can be realized. In addition, the electrophoresis display device can be produced at a low cost to have a simple circuit configuration. In addition, in a case where a TFT (Thin Film Transistor) is used as a driving circuit of the electrophoresis display device, since a low-voltage driving may be realized, it is possible to secure reliability of the TFT.

In addition, there is disclosed a circuit where a memory cell is provided to each of the pixels, such that it is possible to store data written to each of the pixels (see JP-A-58-143389). In a pixel driving circuit having such a circuit configuration, when data to be written to the pixel is the same to that written already, it is unnecessary to transfer the data to the pixel, such that it is possible to stop a periphery circuit, and thereby it is possible to expect a remarkable decrease in power consumption.

Here, description will be given with respect to the common oscillation driving. FIG. 10 shows an example of a timing chart of the common oscillation driving in the electrophoresis display device of the related art. First, prior to the description with reference to FIG. 10, the electrophoresis display device is assumed as described below. First, each of the pixels in the electrophoresis display device is configured by a plurality of microcapsules including white electrophoresis particles (hereinafter, referred to as "white particles") and black electrophoresis particles (hereinafter, referred to as "black particles"). In addition, in each of the microcapsules, the black particles are charged with a positive polarity (plus: +) and the white particles are charged with a negative polarity (minus: −). In this case, in a case where the pixel electrode is maintained at a high potential (for example, 10 V), when a potential of the common electrode is maintained at a low potential, the black particles in the microcapsule electrically migrate to the common electrode side and thereby a black color is displayed by the pixel. In addition, in a case where the pixel electrode is maintained at a low potential (for example, 0 V), when a potential of the common electrode is maintained at a high potential, the white particles in the microcapsule electrically migrate to the common electrode side and thereby a white color is displayed by the pixel.

In addition, in a case where the potential of the pixel electrode and the common electrode are the same (both are at a low potential or a high potential), the black particles or the white particles in the microcapsule do not electrically migrate and thereby the present display state is maintained.

With respect to the timing of the common oscillation driving in the electrophoresis display device of the related art, as shown in FIG. 10, in a display set-up period, data for a black display is written to a memory cell of a pixel (for example, a pixel B of FIG. 10) for displaying a black color and data for a white display is written to a memory cell of a pixel (a pixel W of FIG. 10) for displaying a white color. In the display set-up period, the potential of all the pixel electrodes is allowed to be equal to that of the common electrode. Then, in a display rewrite period, the potential of the pixel electrode of each of the pixels is changed according to the written data and a potential VCOM of the common electrode is periodically changed to a high potential or a low potential. Therefore, due to an electric field generated in the microcapsule in each of the pixels by a potential difference between the pixel electrode and the common electrode, a black display and a white display are alternately written to each of the pixels. As described above, the potential VCOM of the common electrode is periodically selected from the high potential and the low potential and thereby writing is performed to each of the pixels, such that an image corresponding to written data is displayed to the electrophoresis display device.

As described above, in the electrophoresis display device, the black particles or the white particles alternately electrically migrate according to the potential of the pixel electrode and the potential VCOM of the common electrode and thereby a black color or a white color is displayed in each of the pixels. In the common oscillation driving, when a cycle (potential selection cycle) of periodically selecting the potential VCOM of the common electrode into a high potential and a low potential becomes rapid, there is an advantage that the human eye perceives as if a black color and a white color are concurrently written, despite that a pixel where a black color is displayed and a pixel where a white color is displayed are actually alternately changed.

As described above, two kinds of electrophoresis particles including black particles for displaying a black color and white particles for displaying a white color are present in an electrophoresis display device. A migration speed when the white particles electrically migrate and a migration speed when the black particles electrically migrate in a microcapsule may not be equal, and may be different between the black particles and the white particles.

For example, it is assumed that the migration speed of the white particles is fast, and the migration speed of the black particles is slow. At this time, in a case where a writing time of a pixel by a common oscillation driving is determined depending on a characteristic of the migration speed of the white particles, the electrophoresis of the black particles of which the migration speed is slow becomes insufficient, and thereby the black color may be insufficiently displayed. In addition, on the contrary, in a case where the writing time of the pixel by the common oscillation driving is determined depending on a characteristic of the migration speed of the black particles, writing with respect to the pixel where the white color is displayed becomes excessive and thereby the reliability of the electrophoresis display device may be lowered.

Therefore, in the common oscillation driving of the related art, there is a problem that the characteristics of a migration speed of the electrophoresis particles are not considered.

SUMMARY

An advantage of some aspects of the invention is to provide a method of driving an electrophoresis display device, in which it is possible to drive each pixel of the electrophoresis display device in consideration of a migration speed characteristic of electrophoresis particles, an electrophoresis display device, and an electronic apparatus.

According to an aspect of the invention, there is provided a method of driving an electrophoresis display device including a display unit having a plurality of pixel electrodes, a common electrode opposite to the plurality of pixel electrodes, and a first and second electrophoresis particles that are disposed between the plurality of pixel electrodes and the common electrode, the first electrophoresis particles being charged with a positive polarity and the second electrophoresis particles being charged with a negative polarity. The method includes applying a first or second potential to each of the pixel electrodes, and applying the first or second potential, which are periodically switched, to the common electrode, when an image displayed on the display unit is rewritten. When the first and second potentials are periodically applied to the common electrode, the application of the first potential for a first application time and the application of the second potential for a second application time different from the first application time are repeatedly performed.

According to this aspect of the invention, it is possible to make different the first application time for applying the first potential and the second application time for applying the second potential to the common electrode of the pixel. Therefore, it is possible to change a duty ratio of a cycle of a potential applied to the common electrode of the pixel. As a result, when a period of a first cycle of the potential applied to the common electrode is reviewed as an example, even when an electrical migration speed of electrophoresis particles becomes different for each of the electrophoresis particles, all of the electrophoresis particles electrically migrate with the same migration distance and thereby it is possible to perform a common oscillation driving of the electrophoresis display device. Therefore, it is possible to make a user of the electrophoresis display device perceive as if each color displayed by the electrophoresis display device is concurrently written.

In addition, in the method of driving an electrophoresis display device, the first and second application times may be set such that a distance where the first electrophoresis particles electrically migrate according to a potential difference between the first and second potentials that are applied for the first application time is the same as a distance where the second electrophoresis particles electrically migrate according to the potential difference applied for the second application time.

According to this aspect of the invention, it is possible to determine the duty ratio of the cycle of the potential applied to the common electrode of the pixel, in consideration of a characteristic of a migration speed of the electrophoresis particles. Therefore, even when the electrical migration speed of the electrophoresis particles is different for each of the electrophoresis particles, and thereby the times taken until the writing of each color in the electrophoresis display device is completed are different, it is possible to perform a common oscillation driving of the electrophoresis display device similarly to a case where the writing times of the colors are the same. As a result, it is possible to make a user of the electrophoresis display device perceive as if each color displayed by the electrophoresis display device is concurrently written and it is possible to realize an optimal display capable of reducing a decrease in reliability due to deficiency in a writing to a specific pixel or excessiveness in a writing to a specific pixel.

In the method of driving an electrophoresis display device, the first and second application time may be set such that a time obtained by adding the first and second application times is 50 ms or less.

According to this aspect of the invention, it is possible to allow a time for which a reflection ratio is decreased, which is generated when the electrophoresis display device switches a display of an image by the common oscillation driving, to be a short time to a degree where it is not recognized by people. For example, it is possible to suppress a phenomenon such as a flicker in the common oscillation driving, which may give a visual stress to the user. Therefore, it is possible to provide an electrophoresis display device excellent in a display quality.

In addition, according to another aspect of the invention, there is provided an electrophoresis display device including a display unit having a plurality of pixel electrodes, a common electrode opposite to the plurality of pixel electrodes, and first and second electrophoresis particles that are disposed between the plurality of pixel electrodes and the common electrode, the first electrophoresis particles being charged with a positive polarity and the second electrophoresis particles being charged with a negative polarity; a driving circuit that supplies a potential to the plurality of pixel electrodes and the common electrode; and a control unit that controls the driving circuit. The driving circuit is controlled by the control unit such that a first or second potential is applied to each of the pixel electrodes, and the first or second potential, which are periodically switched, is applied to the common electrode, when an image displayed on the display unit is rewritten. When the first and second potentials are periodically applied to the common electrode, the driving circuit is controlled by the control unit such that the application of the first potential for a first application time and the application of the second potential for a second application time different from the first application time are repeatedly performed.

According to this aspect of the invention, it is possible to provide an electrophoresis display device capable of performing a common oscillation driving where a duty ratio is changed to a time for which the first application time for applying the first potential and the second application time for applying the second potential to the common electrode of the pixel are different. Therefore, when a period of a first cycle of the potential applied to the common electrode is reviewed as an example, even when an electrical migration speed of electrophoresis particles becomes different for each of the electrophoresis particles, all of the electrophoresis particles electrically migrate with the same migration distance and thereby it is possible to control the electrophoresis display device by the common oscillation driving. As a result, it is possible to realize the electrophoresis display device capable of making a user of the electrophoresis display device perceive as if each color displayed by the electrophoresis display device is concurrently written.

In addition, according to still another aspect of the invention, there is provided an electronic apparatus including an electrophoresis display device described above.

According to this aspect of the invention, it is possible to provide an electronic apparatus including an electrophoresis display device that allows each color displayed by the electrophoresis display device to be perceived as if each color is concurrently written, that does not give a visual stress to a user, and that is excellent in a display quality.

According to above-described aspects of the invention, it is possible to drive each pixel of the electrophoresis display device in consideration of the electrical migration speed of the electrophoresis particles.

BRIEF DESCRIPTION OF THE DRAWINGS

The invention will be described with reference to the accompanying drawings, wherein like numbers reference like elements.

FIGS. 8A to 8C-2 are views schematically illustrating examples of a pixel writing in the electrophoresis display device of the embodiment and the electrophoresis display device of the related art.

DESCRIPTION OF EXEMPLARY EMBODIMENTS

Electrophoresis Display Device

Hereinafter, an embodiment of the invention will be described with reference to drawings. In addition, this embodiment represents an aspect of the invention and is not intended to limit the invention, but may be modified in an arbitrary manner without departing from a technical scope of the invention. In addition, in the following drawings, scales and numbers in each structure are illustrated differently from those of an actual structure for an easy understanding.

Figure 1:
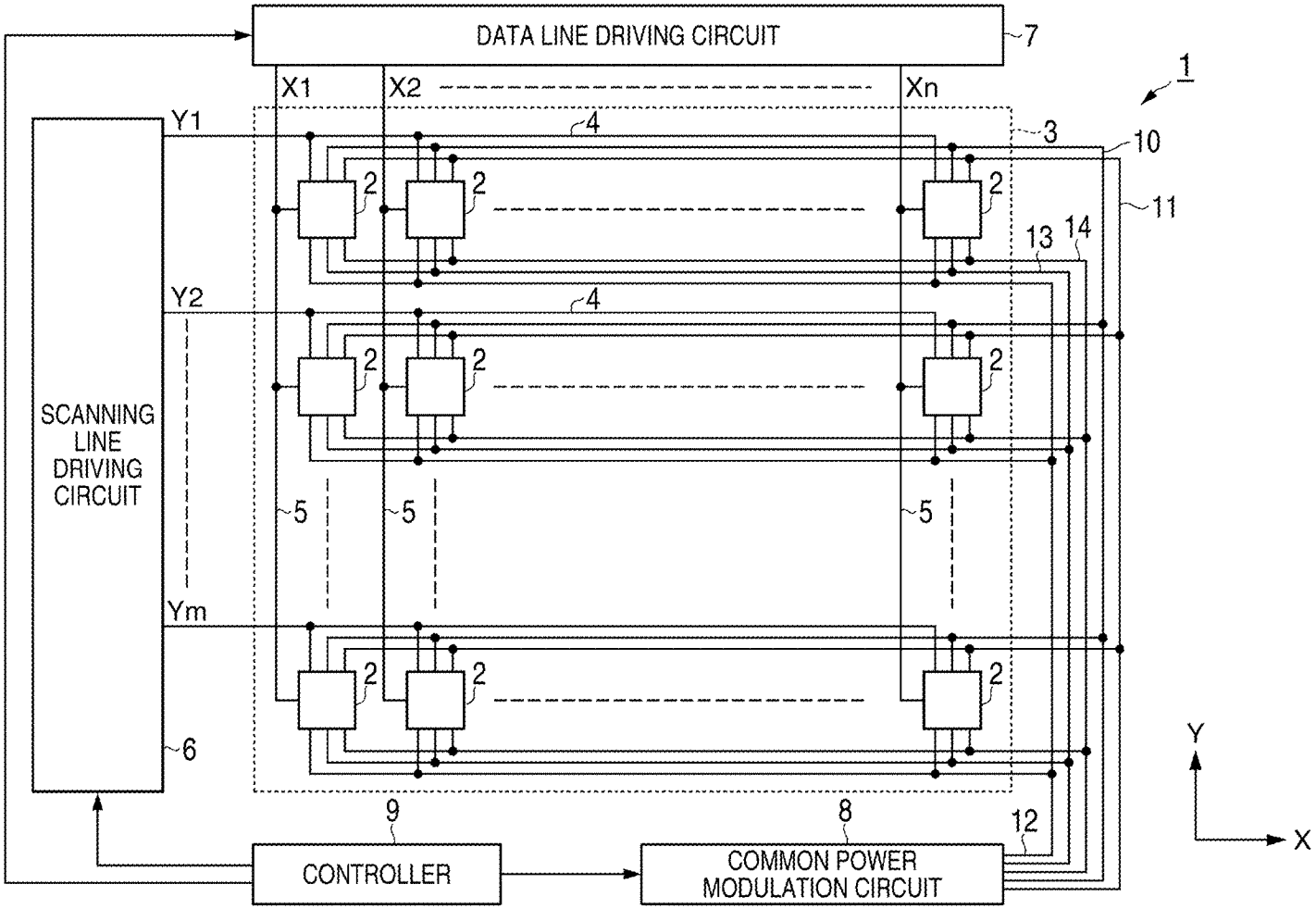
FIG. 1 is a block diagram illustrating a schematic configuration of an electrophoresis display device according to an embodiment of the invention.

FIG. 1 is a block diagram illustrating a schematic configuration of an electrophoresis display device according to an embodiment of the invention. In FIG. 1, an active matrix type electrophoresis display device is shown as an example of this embodiment. The electrophoresis display device 1, which is shown in FIG. 1, includes a display unit 3 in which a plurality of pixels 2 are arranged in a matrix shape, a scanning line driving circuit 6, a data line driving circuit 7, a common power modulation circuit 8 and a controller 9, which are provided at a peripheral region of the display unit 3.

In the display unit 3, m pixels 2 are arranged along a Y-direction and n pixels 2 are arranged along an X-direction. Each pixel 2 in the display unit 3 is arranged at intersections of a plurality of scanning lines 4 extending from the scanning line driving circuit 6 and a plurality of data lines 5 extending from the data line driving circuit 7, respectively.

The scanning line driving circuit 6 outputs a selection signal for selecting the pixel 2 designated by the controller 9 for each row of the pixels 2 arranged in an X-axis direction (row direction) of the display unit 3. When outputting the selection signal, the scanning line driving circuit 6 sequentially outputs the selection signal to the plurality of scanning lines 4 (Y1, Y2, . . . , Ym) wired along the X-axis of the display unit 3. A potential of the data lines 5, which is output from the data line driving circuit 7, is written to the pixel 2 selected by the selection signal.

In addition, in this embodiment, in a case of selecting the pixel 2, the potential of the scanning lines 4 is allowed to be a high potential ("High" level) and in a case of not selecting the pixel 2, the potential of the scanning lines 4 is allowed to be a low potential ("Low" level).

The data line driving circuit 7 outputs an image data input from the controller 9 to the plurality of data lines 5 (X1, X2, . . . , Xn) wired along the Y-axis direction of the display unit 3, respectively, for each column of pixels 2 arranged in the Y-axis direction of the display unit 3. The image data output from the data line driving circuit 7 to the data line 5 is written to the pixel 2 of a column selected by the selection signal output from the scanning line driving circuit 6.

In addition, in this embodiment, in a case where image data "0" is written to the pixel 2, the potential of the data line 5 is allowed to be a low potential ("Low" level), and in a case where image data "1" is written to the pixel 2, the potential of the data line 5 is allowed to be a high potential ("High" level).

The common power modulation circuit 8 supplies a potential, which serves as a power source of a pixel circuit in each of the pixels, to a pixel circuit ground line 10 used in common with all of the pixels 2 and a pixel circuit power supply line 11. In addition, the common power modulation circuit 8 supplies a potential necessary for driving each pixel 2 to a common electrode power supply line 12 and pixel control lines 13 and 14, according to the control of the controller 9. Each pixel 2 electrically migrates electrophoresis particles in the pixel 2 according to written image data, and the potentials of the common electrode power supply line 12, the pixel control line 13 and the pixel control line 14, which are supplied from the common power modulation circuit 8, and thereby a display image is displayed in the electrophoresis display device 1.

Each of the potential S1 supplied to the pixel control line 13 and the potential S2 supplied to the pixel control line 14, from the common power modulation circuit 8, is switched by the control of the controller 9 so as to change the display of each of the pixel 2 according to the image data written to the each pixel 2. In addition, each of the potential S1 supplied to the pixel control line 13 and the potential S2 supplied to the pixel control line 14, from the common power modulation circuit 8, is allowed to be a high impedance state (Hi-Z) so as to maintain a present display state displayed in each pixel 2 by the control of the controller 9.

The potential VCOM supplied to the common electrode power supply line 12 from the common power modulation circuit 8 is switched by the control of the controller 9 so as to change the display of each pixel 2 according to the image data written to the each pixel 2. For example, the potential VCOM supplied to the common electrode power supply line 12 is periodically switched to a high potential ("High" level) and a low potential ("Low" level) to perform a common oscillation driving of each pixel 2. Therefore, a migration distance of the electrophoresis particles in each pixel 2 is controlled, such that it is possible to make a user of the electrophoresis display device 1 recognize as if a black color and a white color are concurrently written. In addition, the potential VCOM supplied to the common electrode power supply line 12 from the common power modulation circuit 8 is allowed to be a high impedance state (Hi-Z) state by the control of the controller 9 to maintain a present display state displayed in each pixel 2.

The controller 9 controls the operation of each of the scanning line driving circuit 6, the data line driving circuit 7 and the common power modulation circuit 8, based on a control signal input from a control unit such as a CPU (Central Processing Unit) (not shown) of the electrophoresis display device 1.

Figure 2:
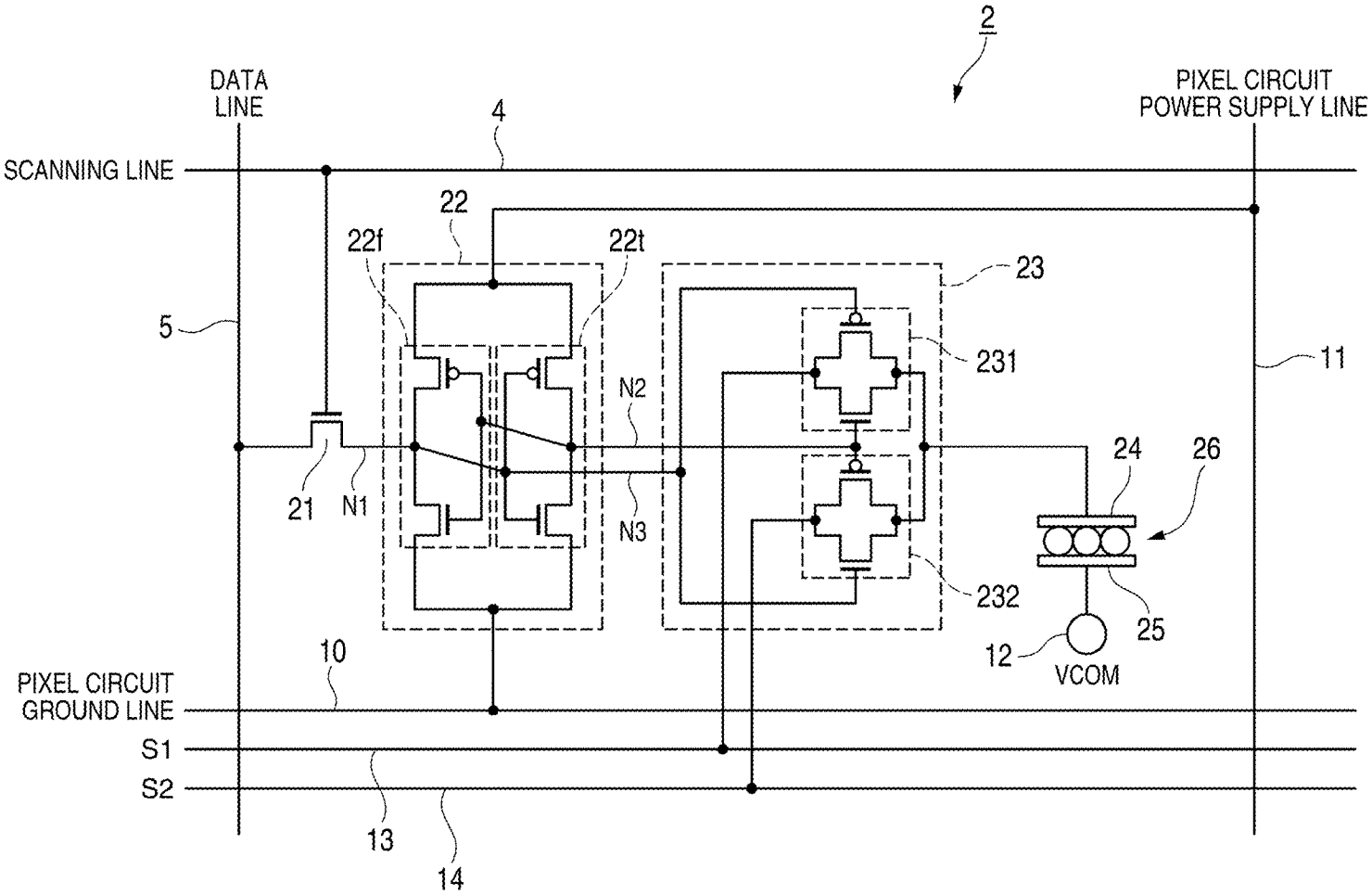
FIG. 2 is a block diagram illustrating an example of a pixel circuit of the electrophoresis display device of the embodiment.

Next, description will be given with respect to a configuration of a pixel circuit of the electrophoresis display device. FIG. 2 a block diagram illustrating an example of a circuit configuration of the pixel 2 in the electrophoresis display device 1 according to this embodiment. In FIG. 2, the pixel 2 includes a selection transistor (thin film transistor) 21, a latch circuit 22, a switch circuit 23, a pixel electrode 24, a common electrode 25 and an electrophoresis element 26. The scanning line 4, the data line 5, the pixel circuit ground line 10, the pixel circuit power supply line 11, the common electrode power supply line 12, the pixel control line 13 and the pixel control line 14 are connected to each pixel 2. By the configuration shown in FIG. 2, the pixel 2 is configured by so-called 9T (9 transistors) type pixel structure that is constructed by 9 transistors. In addition, the pixel 2 has a SRAM (Static Random Access Memory) type configuration where a potential of image data is stored by the latch circuit 22.

The selection transistor 21 is a pixel switching element that selects the pixel 2 and is configured by, for example, an N-type MOS (Metal Oxide Semiconductor). A gate terminal, a source terminal and a drain terminal of the selection transistor 21 connect to the scanning line 4, the data line 5 and an input terminal N1 of the latch circuit 22, respectively. During this period the selection signal is input from the scanning line driving circuit 6 via the scanning line 4, the selection transistor 21 connects the data line 5 and the latch circuit 22 to input the image data input from the data line driving circuit 7 via the data line 5 to the latch circuit 22.

The latch circuit 22 is a circuit that stores the image data input to the pixel 2 and includes a transfer inverter 22*t* and a feedback inverter 22*f*, which are configured by, for example, CMOS (Complementary Metal Oxide Semiconductor). In addition, the pixel circuit power supply line 11 and the pixel circuit ground line 10 connect to a power source and a ground terminal of the transfer inverter 22*t* and the feedback inverter 22*f*, respectively. The transfer inverter 22*t* and the feedback inverter 22*f* are configured by a loop structure where each input thereof connects to an output of the other side, respectively. Due to the loop structure, the latch circuit 22 stores the image data input from the data line driving circuit 7 to the input terminal of the transfer inverter 22*t* that is the input terminal N1 of the latch circuit 22 via the selection transistor 21. The output terminal of the transfer inverter 22*t* as an output terminal N2 of the latch circuit 22 and the output terminal of the feedback inverter 22*f* as an output terminal N3 of the latch circuit 22 connect to a gate terminal of the switch circuit 23, respectively.

The switch circuit 23 is a selector circuit that selects a potential of the pixel control line 13 or the pixel control line 14 and outputs it to the pixel electrode 24 according to the image data of the pixel 2, which is stored in the latch circuit 22. For example, the switch circuit 23 includes transmission gates 231 and 232 configured by a CMOS. The output terminals N2 and N3 of the latch circuit 22 connect to gate terminals of the transmission gates 231 and 232, respectively. In addition, the pixel control line 13 and the pixel control line 14 connect to a source terminal of the transmission gate 231 and a source terminal of the transmission gate 232, respectively. A drain terminal of the transmission gate 231 and a drain terminal of the transmission gate 232 connect to the pixel electrode 24.

The switch circuit 23 allows either the transmission gate 231 or the transmission gate 232 to be an ON state according to the image data ("0"="Low" level, or "1"="High" level) output to the output terminals N2 and N3 of the latch circuit 22. The potential S1 of the pixel control line 13 or the potential S2 of the pixel control line 14 connected to the transmission gate 231 or 232 that is the ON state is output to the pixel electrode 24.

Next, the potential output to the pixel electrode 24 will be described in detail. In a case where "0" ("Low" level) is written as an image data of the pixel 2, the data line driving circuit 7 allows the potential of the data line 5 to be a low potential ("Low" level). The scanning line driving circuit 6 selects the pixel 2 by the scanning line 4. Therefore, the selection transistor 21 comes to be in the ON state and an output of the transfer inverter 22*t* in the latch circuit 22 becomes a "High" level. In addition, the output of the feedback inverter 22*f* in the latch circuit 22 becomes a "Low" level by the output of the "High" level of the transfer inverter 22*t*. The output of the "High" level of the transfer inverter 22*t* is maintained by the output of the "Low" level of the feedback inverter 22*f*.

As described above, the "Low" level of the data line 5 is stored in the latch circuit 22. The transmission gate 231 comes to be in the ON state and the transmission gate 232 becomes OFF state according to the "High" level of the output terminal N2 of the latch circuit 22 that is the output terminal of the transfer inverter 22*t* and the "Low" level of the output terminal N3 of the latch circuit 22 that is the output terminal of the feedback inverter 22*f*, and the potential S1 of the pixel control line 13 is output to the pixel electrode 24.

On the other hand, in a case where "1" ("High" level) is written as an image data of the pixel 2, the data line driving circuit 7 allows the potential of the data line 5 to be a high potential ("High" level). The scanning line driving circuit 6 selects the pixel 2 by the scanning line 4. Therefore, the selection transistor 21 comes to be in the ON state and an output of the transfer inverter 22*t* in the latch circuit 22 becomes a "Low" level. In addition, the output of the feedback inverter 22*f* in the latch circuit 22 becomes a "High" level by the output of the "Low" level of the transfer inverter 22*t*. The output of the "Low" level of the transfer inverter 22*t* is maintained by the output of the "High" level of the feedback inverter 22*f*.

As described above, the "High" level of the data line 5 is stored in the latch circuit 22. The transmission gate 231 comes to be in an OFF state and the transmission gate 232 comes to be in the ON state according to the "Low" level of the output terminal N2 of the latch circuit 22 that is the output terminal of the transfer inverter 22*t* and the "High" level of the output terminal N3 of the latch circuit 22 that is the output terminal of the feedback inverter 22*f*, and the potential S2 of the pixel control line 14 is output to the pixel electrode 24.

As described above, the pixel control line 13 or 14 is selected according to the image data, and the potential S1 or S2 of the selected pixel control line 13 or 14 is output to the pixel electrode 24 via the switch circuit 23.

The electrophoresis element 26 is interposed between the pixel electrode 24 and the common electrode 25 and white particles and black particles in a plurality of microcapsules provided to the electrophoresis element 26 electrically migrate by a potential difference between the pixel electrode 24 and the common electrode 25. A grayscale image is displayed according to an electrophoresis distance of the white particles and the black particles.

In the common oscillation driving, it is possible to control an electrophoresis direction of the white particles and the black particles by the potential S1 of the pixel control line 13 and the potential S2 of the pixel control line 14, which are input to the pixel electrode 24. In addition, it is possible to control the electrophoresis distance of the white particle and the black particle by the potential VCOM input to the common electrode 25.

The electrophoresis direction and distance of the white particles and the black particles can be controlled, such that it is possible to control the grayscale of an image displayed by the pixel 2.

Figure 3A:
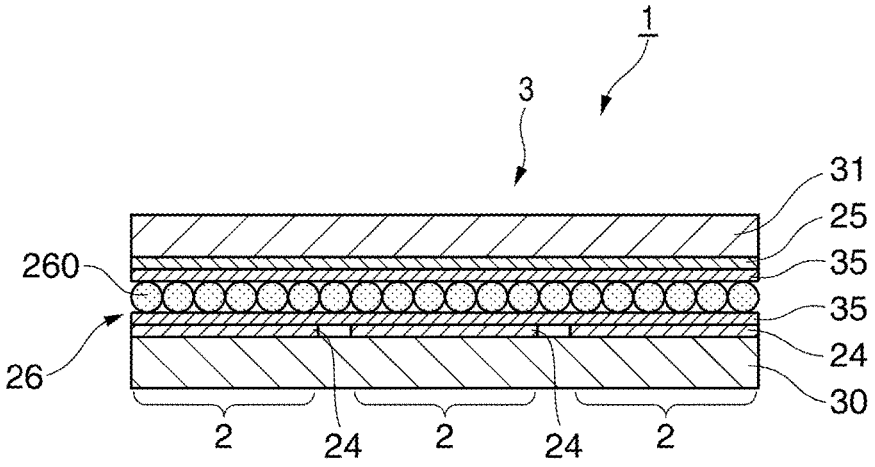
FIGS. 3A and 3B are views illustrating an example of a configuration of the display unit of the electrophoresis display device of the embodiment.
Figure 3B:
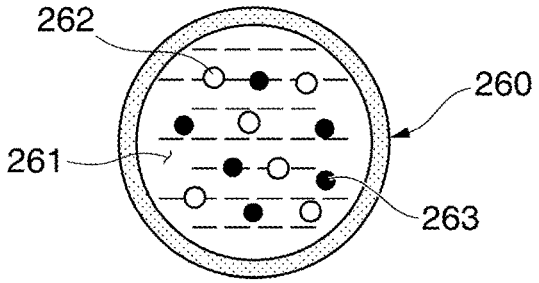

Next, description will be given with respect to the display unit 3 of the electrophoresis display device of this embodiment. FIGS. 3A and 3B show views illustrating an example of a configuration of the display unit 3 of the electrophoresis display device 1 according to this embodiment. FIG. 3A shows a cross sectional view of the display unit 3. In addition, FIG. 3B shows a schematic diagram of a microcapsule.

As shown in FIG. 3A, the display unit 3 has a configuration where the electrophoresis element 26 is interposed between an element substrate 30 provided with the pixel electrode 24 and a counter substrate 31 provided with the common electrode 25. The electrophoresis element 26 includes a plurality of microcapsules 260. The electrophoresis element 26 is fixed between the element substrate 30 and the counter substrate 31 by an adhesive layer 35. That is, adhesive layers 35 are formed between the electrophoresis element 26, the element substrate 30 and the counter substrate 31.

In addition, the adhesive layer 35 formed at the element substrate 30 side is necessary for the bonding with a surface of the pixel electrode 24, but the adhesive layer 35 formed at the counter substrate 31 side may be not requisite. This is because that it can be assumed a situation where the common electrode 25, the plurality of microcapsules 260 and the adhesive layer 35 formed at the counter substrate 31 side are assembled in a constant manufacturing process and when the resultant product is handled as an electrophoresis sheet, only the adhesive layer 35 formed at the element substrate 30 side is needed as an adhesive layer.

The element substrate 30 is a substrate made of, for example, glass, plastic, or the like. The pixel electrode 24 formed in a rectangular shape for each pixel 2 is formed on the element substrate 30. Although it is not shown in FIG. 3A, at a region between the pixel electrodes 24 and on a lower surface of the pixel electrode 24 (in FIG. 3A, a layer located at the element substrate 30 side), the scanning line 4, the data line 5, the pixel circuit ground line 10, the pixel circuit power supply line 11, the common electrode power supply line 12, the pixel control line 13, the pixel control line 14, the selection transistor 21, the latch circuit 22, the switch circuit 23, or the like are formed.

Since the counter substrate 31 becomes an image display side, the counter substrate 31 is made of a substrate having a light transmitting property such as glass. As the common electrode 25 formed on the counter substrate 31, a material such as MgAg (magnesium silver), ITO (Indium Tin Oxide) and IZO (registered trade mark: Indium Zinc Oxide), which has a light transmitting property and a conductive property, may be used.

In addition, the electrophoresis element 26 is generally handled as an electrophoresis sheet including the adhesive layer 35 formed in advance at the counter substrate 31 side. In addition, at the adhesive layer 35 side, a protective release paper is pasted.

In a manufacturing process, the release paper is peeled off and the electrophoresis sheet is pasted with the element substrate 30 in which the pixel electrode 24, circuits and the like are formed, thereby forming the display unit 3. Therefore, in a general configuration, the adhesive layer 35 is only formed on the pixel electrode 24 side.

FIG. 3B shows a configuration diagram of a microcapsule 260. For example, the microcapsule 260 has a particle of about 50 μm. In addition, a casing of the microcapsule 260 is formed by using a polymer resin having a light transmitting property, for example, an acrylic resin such as poly (methyl methacrylate) and poly(ethyl methacrylate); urea resin; gum arabic; or the like. The microcapsule 260 is interposed between the common electrode 25 and the pixel electrode 24, and one or a plurality of microcapsules 260 are arranged in a lengthwise and crosswise direction in one pixel. A binder (not shown) fixing the microcapsules 260 is provided to bury the periphery of the microcapsules 260.

In addition, a dispersion medium 261, charged particles of a plurality of white particles 262 and a plurality of black particles 263 as an electrophoresis particle are sealed inside the microcapsules 260.

The dispersion medium 261 is a liquid for dispersing the white particles 262 and the black particles 263 inside the microcapsule 260.

As the dispersion medium 261, for example, water; alcohol-based solution such as methanol, ethanol, isopropanol, butanol, octanol and methyl cellosolve; various kinds of ester such as ethyl acetate and butyl acetate; ketones such as acetone, methyl ethyl ketone and methyl isobutyl ketone; aliphatic hydrocarbon such as pentane, hexane and octane; cycloaliphatic hydrocarbon such as cyclohexane and methylcyclohexane; aromatic hydrocarbon such as benzenes having a long chain alkyl group such as benzene, toluene, xylene, hexylbenzene, hebutylbenzene, octylbenzene, nonylbenzene, decylbenzene, undecylbenzene, dodecylbenzene, tridecylbenzene, and tetradecylbenzene; halogenated hydrocarbon such as chlorometylene, chloroform, carbon tetrachloride, and 1,2-dichloroethane; carboxylate; various kinds of oil thereof; or the like. These may be used singly or as a compound obtained by mixing a surfactant or the like to a mixture thereof.

The white particle 262 is, for example, a particle (polymer or colloid) composed of a white pigment such as titanium dioxide, zinc oxide and antimony trioxide and is charged with a negative polarity (minus: −) as an example.

The black particle 263 is, for example, a particle (polymer or colloid) composed of a black pigment such as aniline black and carbon black and is charged with a polarity (plus: +) as an example.

Therefore, the white particle 262 and the black particle 263 can migrate in an electric field generated by a potential difference between the pixel electrode 24 and the common electrode 25 in the dispersion medium 261.

In these pigments, an electrolyte, a surfactant, a metal soap, a resin, rubber, oil, varnish, a charging control agent including a particle such as a compound, a dispersion agent such as a titanium-based coupling agent, an aluminum-based coupling agent and a silane-based coupling agent, a lubricant agent, a stabilizing agent, or the like may be added.

Figure 4A:
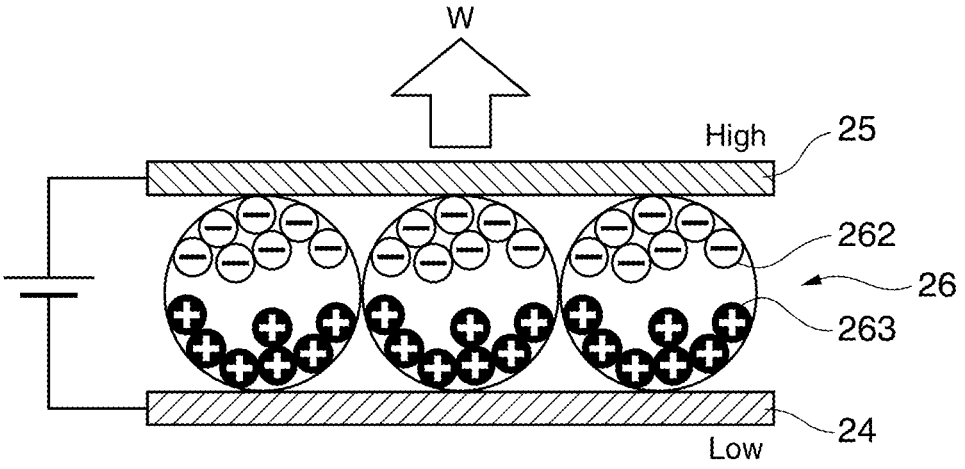
FIGS. 4A and 4B are views illustrating an example of an operation of an electrophoresis element in the electrophoresis display device of the embodiment.
Figure 4B:
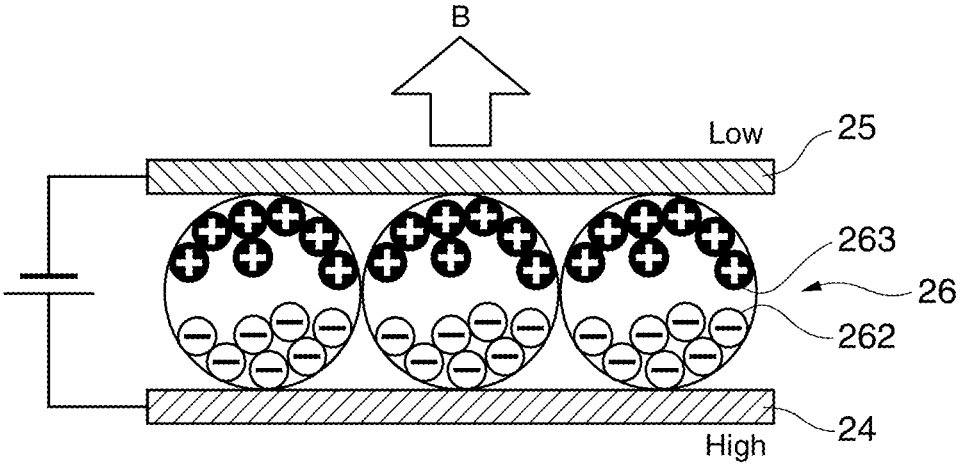

Next, an operation of the electrophoresis element in the electrophoresis display device of this embodiment will be described. FIGS. 4A and 4B show views illustrating an example of an operation of the electrophoresis element 26 in the electrophoresis display device 1 of this embodiment. FIG. 4A shows a case where the pixel 2 performs a white display and FIG. 4B shows a case where the pixel 2 performs a black display.

In addition, in the following description, it is assumed that the white particle 262 is charged with a negative polarity (minus: −) and the black particle 263 is charged with a positive polarity (plus: +). In addition, is assumed that the potential S1 of the pixel control line 13 is maintained at a high potential ("High" level) at all times and the potential S2 of the pixel control line 14 is maintained at a low potential ("Low" potential) at all times. In this embodiment, the black particle 263 charged with a positive polarity corresponds a first electrophoresis particle, and the white particle 262 charged with a negative polarity corresponds to a second electrophoresis particle.

As shown in FIG. 4A, in a case where a white display is performed by the pixel 2, "1" ("High" level) as an image data is written. Therefore, the potential S2 (low potential) of the pixel control line 14 is input to the pixel electrode 24, and thereby the pixel electrode 24 becomes a "Low" level. Then, when a potential VCOM of a high potential ("High" level) is input to the common electrode 25 from the common electrode power supply line 12, a potential difference between the pixel electrode 24 and the common electrode 25 is generated and thereby the white particle 262 electrically migrates toward the common electrode 25 side and the black particle 263 electrically migrates toward the pixel electrode 24 side, whereby the pixel 2 performs a white (W) display.

On the other hand, in this case, when a potential VCOM of a low potential ("Low" level) is input to the common electrode 25 from the common electrode power supply line 12, since the potential difference between the pixel electrode 24 and the common electrode 25 is not generated, the white particle 262 and the black particle 263 do not electrically migrate, whereby a present display state is maintained.

In addition, as shown in FIG. 4B, a black display is performed by the pixel 2, "0" ("Low" level) as an image data is written. Therefore, the potential S1 (high potential) of the pixel control line 13 is input to the pixel electrode 24, and thereby the pixel electrode 24 becomes a "High" level. Then, when a potential VCOM of a low potential ("Low" level) is input to the common electrode 25 from the common electrode power supply line 12, a potential difference between the pixel electrode 24 and the common electrode 25 is generated and thereby the black particle 263 electrically migrates toward the common electrode 25 side and the white particle 262 electrically migrates toward the pixel electrode 24 side, whereby the pixel 2 performs a black (B) display.

On the other hand, in this case, when a potential VCOM of a high potential ("High" level) is input to the common electrode 25 from the common electrode power supply line 12, since the potential difference between the pixel electrode 24 and the common electrode 25 is not generated, the white particle 262 and the black particle 263 do not electrically migrate, whereby a present display state is maintained.

Therefore, the electrophoresis element 26 is selected based on the image data written to the pixel 2 and it is possible to control an electrical migration of the white particle and the black particle according to the potential S1 of the pixel control line 13 or the potential S2 of the pixel control line 14, which is input to the pixel electrode 24, and the potential VCOM of the common electrode power supply line 12 input to the common electrode 25.

Hereinafter, the operation where the potential VCOM of the common electrode 25 is set to be a high potential through the writing of the image data, as shown in FIG. 4A, and the pixel 2 is allowed to perform the white display is referred to as "white writing". In addition, the operation where the potential VCOM of the common electrode 25 is set to be a low potential through the writing of the image data, as shown in FIG. 4B, and the pixel 2 is allowed to perform the black display is referred to as "black writing".

Method of Driving Electrophoresis Display Device

Figure 5:
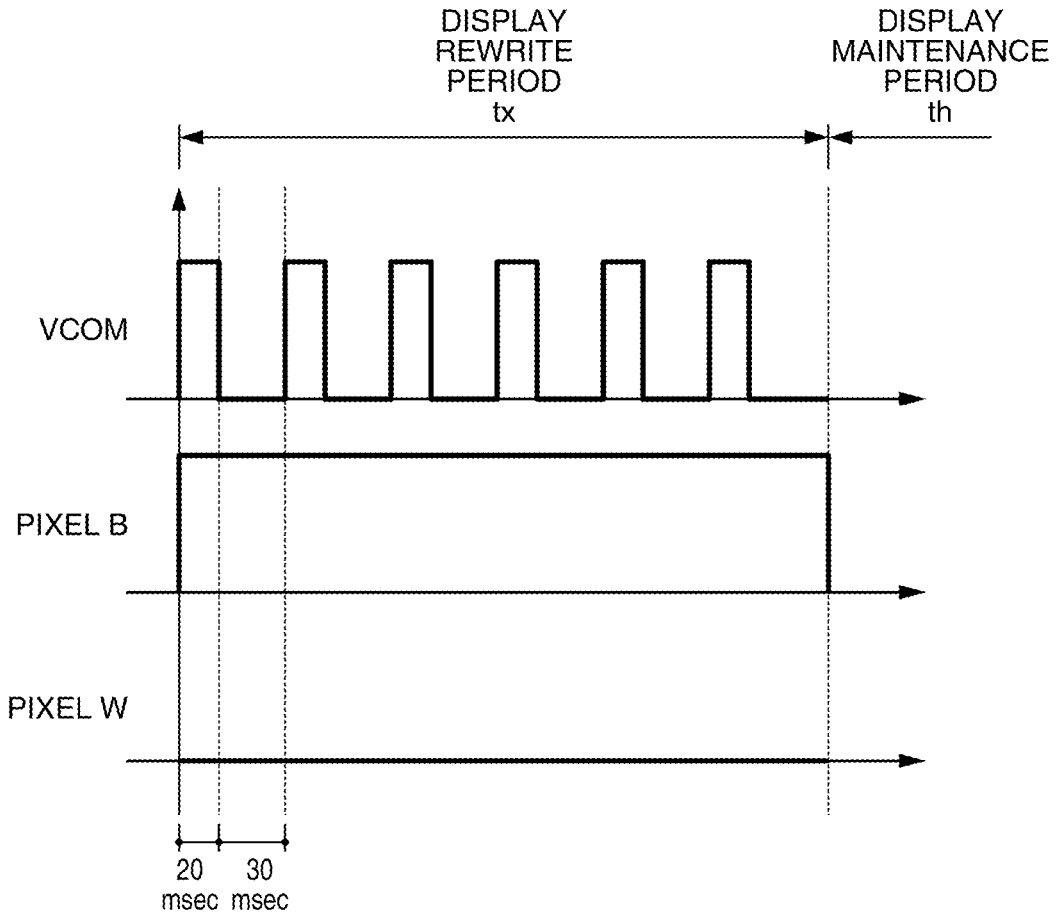
FIG. 5 is a timing chart of a common oscillation driving in the electrophoresis display device of the embodiment.

Next, description will be given with respect to a common oscillation driving that is a method of operating the electrophoresis display device of this embodiment. FIG. 5 shows an example of a timing chart of the common oscillation driving in the electrophoresis display device 1 of this embodiment.

In addition, in the following description, similarly to FIGS. 4A and 4B, it is assumed that the white particle 262 is charged with a negative polarity (minus: −) and the black particle 263 is charged with a positive polarity (plus: +). However, when the same potential difference is generated for the same period, a migration speed of the white particle 262 and a migration speed of the black particle 263 become different. Due to this difference in the migration speed, a time taken for completing the white writing and a time taken for completing the black wiring in the electrophoresis display device 1 become different. In the following description, it is assumed that the migration speed of the black particle 263 is slower than that of the white particle 262, and at a total time of the white writing of 200 ms and a total time of the black writing of 300 ms, each writing is completed.

In addition, similarly to the description of FIGS. 4A and 4B, it is assumed that the potential S1 of the pixel control line 13 is maintained at a high potential ("High" level) at all times and the potential S2 of the pixel control line 14 is maintained at a low potential ("Low" potential) at all times.

Figure 10:
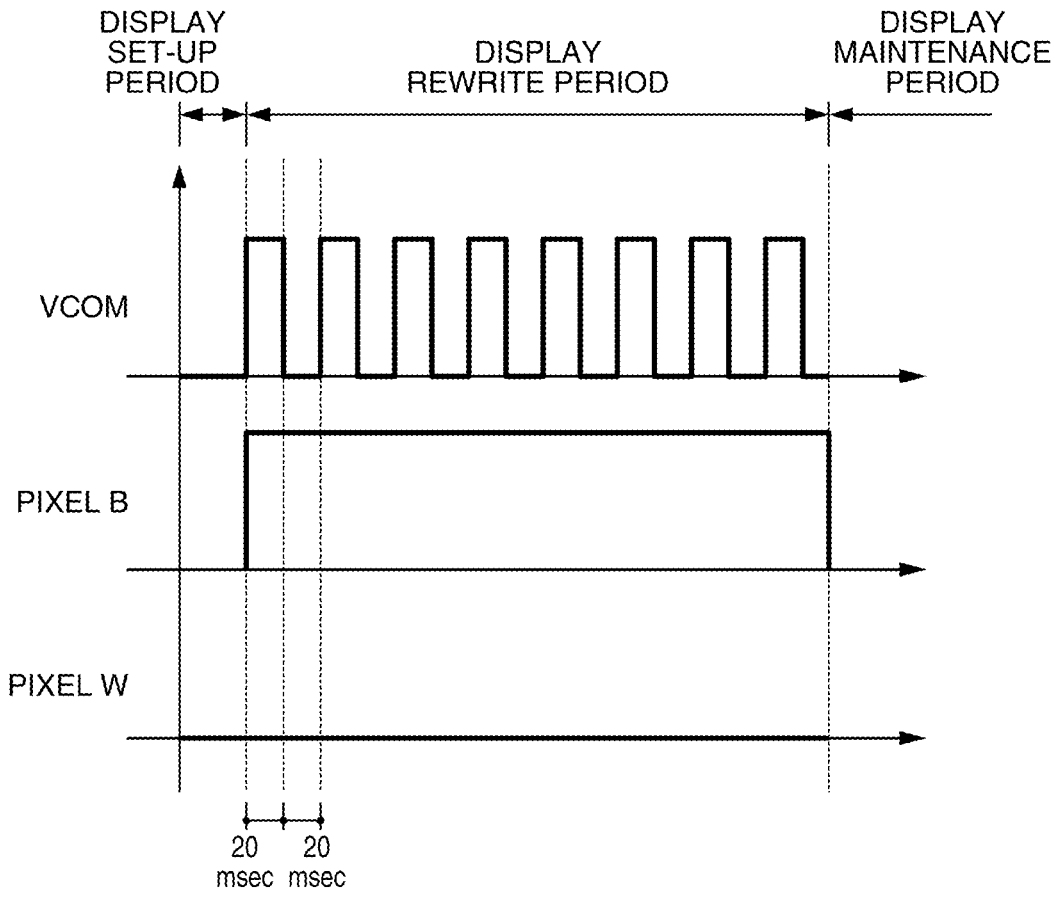
FIG. 10 is an example of a timing chart of a common oscillation driving in the electrophoresis display device of the related art.

In addition, with respect to a period (display set-up period) before the display rewrite period tx, it is assumed that a potential of a pixel electrode 24 of a pixel (for example, the pixel B in FIG. 5) allowed to perform a black display is set to a high potential, and a potential of a pixel electrode 24 of a pixel (for example, the pixel W in FIG. 5) allowed to perform a white display is set to a low potential, similarly to the timing of the common oscillation driving in the electrophoresis display device shown in FIG. 10. Specifically, it is assumed that the potential S1 (high potential) of the pixel control line 13 is input to the pixel electrode 24 of the pixel B and the potential S2 (low potential) of the pixel control line 14 is input to the pixel electrode 24 of the pixel W.

Figure 6:
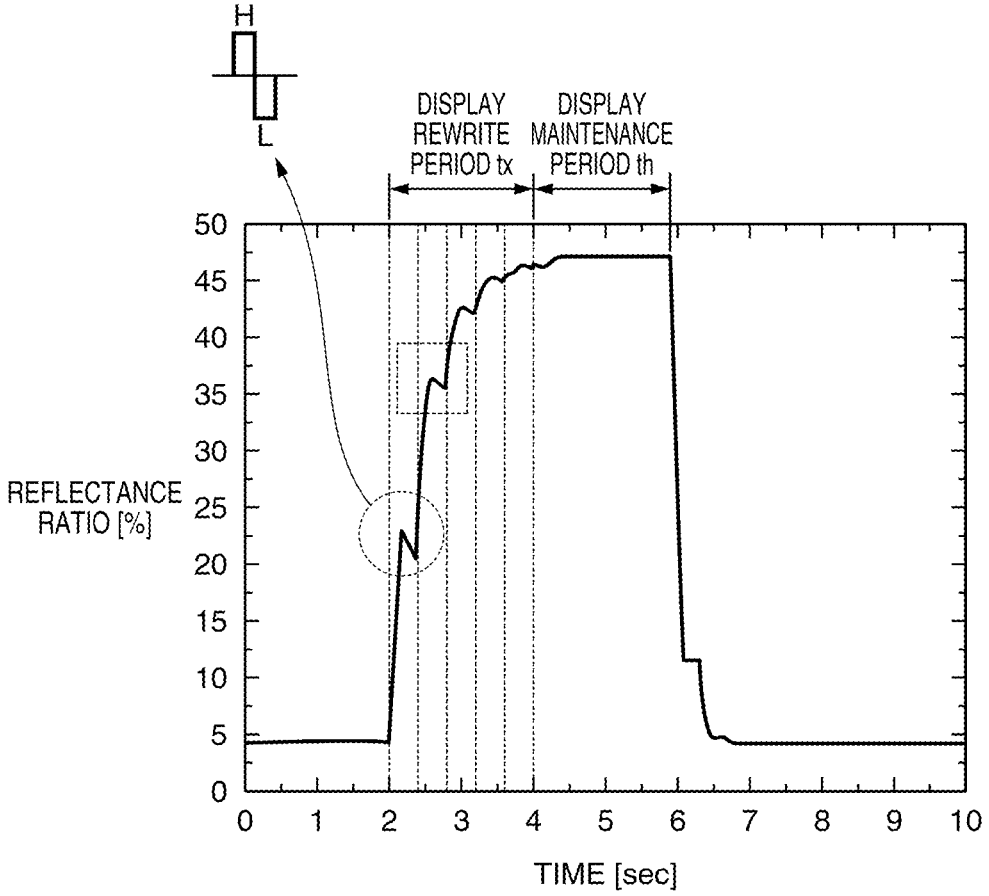
FIG. 6 is a view illustrating a graph obtained by measuring, in time series, a reflection ratio of the electrophoresis display device of the embodiment.

Then, in the display rewrite period tx, as shown in FIG. 6, the potential VCOM of the common electrode power supply line 12 input to the common electrode 25 is periodically switched to a high potential ("High" level) and a low potential ("Low" level). Therefore, an electric field caused by a potential difference between the pixel electrode 24 and the common electrode 25 is generated in the microcapsule 260 in each pixel 2 and a white display and a black display are alternately written to each pixel 2.

Then, in a display maintenance period th, the potential VCOM of the common electrode power supply line 12, which is input to the common electrode 25, is set to be a high impedance state (Hi-Z) or a discharge state (GND). Therefore, a writing state in each pixel 2 is maintained. In addition, in the display maintenance period th, the potential S1 of the pixel control line 13 and the potential S2 of the pixel control line 14, which are input to the pixel electrode 24, are also set to be a high impedance state (Hi-Z) or a discharge state (GND).

In the common oscillation driving in the electrophoresis display device 1 of this embodiment, as shown in FIG. 6, in the display rewrite period tx, the potential VCOM of the common electrode power supply line 12, which is input to the common electrode 25, is periodically switched to a high potential and a low potential. At this time, a time for allowing the potential VCOM to be a high potential ("High" level) and a time for allowing the potential VCOM to be a low potential ("Low" level) are made to be different to each other. That is, a duty of a cycle of the potential VCOM input to the common electrode 25 is changed.

The duty ratio of the cycle of the potential VCOM input to the common electrode 25 is determined by a ratio of a time taken until the white writing by the electrical migration of the white particle 262 is completed and a time taken until the black writing by the electrical migration of the black particle 263 is completed. Specifically, it is possible to determine the duty ratio by the electrical migration speed of the black particle 263 and the electrical migration speed of the white particle 262.

In this embodiment, since the time taken until the white writing is completed is set to 200 ms and the time taken until the black writing is completed is set to 300 ms, a total time for allowing the potential VCOM to be a high potential ("High" level) and a total time for allowing the potential VCOM to be a low potential ("Low" level) can be determined by following equation (1), respectively.

$$W\text{ time}:B\text{ time}=H\text{ total time}:L\text{ total time}=200\text{ ms}:300\text{ ms} \quad (1)$$

In the equation (1), W time represents a time taken until the white writing is completed, B time represents a time taken unit the black writing is completed, H total time represents a total time for allowing the potential VCOM to be a high potential ("High" level) and L total time represents a total time for allowing the potential VCOM to be a low potential ("Low" level).

As can be seen from the equation (1), in this embodiment, the ratio of the electrical migration speed of the white particle 262 and the electrical migration speed of the black particle 263 is 2:3, such that the duty ratio of a cycle of the potential VCOM input to the common electrode 25 becomes H:L=2:3.

In addition, the time for which the potential VCOM input to the common electrode 25 is at a high potential ("High" level width) and the time for which the potential VCOM input to the common electrode 25 is at a low potential ("Low" level width) are determined based on the cycle of the potential VCOM of the common electrode 25. The cycle of the potential VCOM input to common electrode 25 may be determined based on, for example, a flicker in the common oscillation driving (see a graph obtained by measuring a reflection ratio in a sequence of time as shown in FIG. 6). When the flicker of the display image of the electrophoresis display device 1 is at a level that is visible to people, since it the electrophoresis display device 1 gives a visual stress to a user thereof, it is preferable that the flicker is suppressed as much as possible.

Description with respect to the flicker in the common oscillation driving will be given later. It is preferable that even when the reflection ratio decreases, the time for which the reflection ratio decreases is a short time to a extend that is not visible to people, and a frequency of the potential VCOM input to the common electrode 25 is 20 Hz or more that does not give visual stress to a user of the electrophoresis display device 1. Specifically, as shown in the following equation (2), it is preferable that a total time of a width of a "High" level and a width of a "Low" level of the potential VCOM input to the common electrode 25 is 50 ms or less.

$$\text{VCOM frequency} \leq 20\text{ Hz}$$

$$H\text{ time}+L\text{ time} \leq 50\text{ ms}$$

In the equation (2), the VCOM frequency represents a frequency of the potential VCOM input to the common electrode 25, H time represents the width of the "High" level of the potential VCOM and L time represents the width of the "Low" level of the potential VCOM.

Therefore, in the common oscillation driving of this embodiment shown in FIG. 6, as described above, since the duty ratio of the cycle of the potential VCOM is H:L=2:3, the width of the "High" level of the potential VCOM input to the common electrode 25 is set to 20 ms and the width of the "Low" level is set to 30 ms. The potential VCOM having the width of the "High" level of 20 ms and the width of the "Low" level of 30 ms is input to the common electrode 25, such that the black display and the white display are alternately written to each pixel 2. In this embodiment, the time taken until the white writing is completed is 200 ms and the time taken until the black writing is completed is 300 ms, such that the white writing and the black writing with respect to each pixel 2 are completed in a state where the potential VCOM has 10 cycles.

Here, description will be given with respect to the flicker in the common oscillation driving of the electrophoresis display device 1. FIG. 6 is a view illustrating a graph obtained by setting the potential VCOM of the common electrode 25 to a rectangular wave and by measuring a reflection ratio in time series at the time of allowing the pixel 2 to perform the white display in the electrophoresis display device 1 of the embodiment. In FIG. 6, a horizontal axis shows an elapsed time and in a display rewrite period tx starting at timing after about two seconds has elapsed, the common oscillation driving is performed and then a display maintenance period th continues. The timing of about two seconds, from which the display rewrite period tx starts, represents a start point in the measurement of the reflection ratio, and the display maintenance period th represents a maintenance period of image data at the time of measuring. These periods do not have another meaning. In addition, a vertical axis shows a reflection ratio obtained when the pixel 2 is allowed to perform the white display and an observation is performed from the common electrode 25 side. In addition, the reflection ratio does not reach 50% at a point of time when the display rewrite period tx has elapsed. This is caused by a display characteristic of the electrophoresis element 26. The reflection ratio of the electrophoresis element 26 with respect to a reference reflection plate of a white color is different depending on a specification thereof, but generally shows a value near 50%.

A region enclosed by a dotted circle in the graph of the FIG. 6 represents timing when a first cycle of the rectangular wave is applied. At this timing, when the potential VCOM input to the common electrode 25 is at a low potential ("Low" level), a low potential ("Low" level) is applied to the pixel electrode 24 and the common electrode 25 of the pixel 2 performing a white color display (for example, pixel W in FIG. 5), respectively, such that a potential difference between the pixel electrode 24 and the common electrode 25 is not generated and thereby the white particle 262 and the black particle 263 do not electrically migrate but stay at a present place. Therefore, the reflection ratio actually decreases as shown inside the dotted circle shown in the graph of FIG. 6. This is attributable to a potential difference caused by a current leakage from pixel circuits such as the selection transistor 21, the latch circuit 22 and the switch circuit 23 that are connected to the pixel electrode 24, and represents a situation where the white particle 262 adversely migrates and thereby the flicker is generated.

In a case where the frequency of the potential VCOM input to the common electrode 25 is 20 Hz or less, the time for which the reflection ratio decreases in the display rewrite period tx is relatively long and is at a level that is visible to people, such that this is visualized as the flicker and thereby gives visual stress to a user of the electrophoresis display device 1.

In addition, the generation of the flicker is not limited to a first cycle, but a small degree of a flicker is generated in a second cycle of the rectangular wave, which is represented as a dotted square shown in the graph of FIG. 6. And then, the flicker is also generated a little in a third cycle to a fifth cycle.

In addition, in the description of FIG. 6, the description is given with respect to the white particle 262, but in the common oscillation driving of this embodiment, by the change in a duty ratio of the cycle of the potential VCOM in the common electrode 25, the electrical migration speed of the white particle 262 and the black particle 263 in the first cycle is controlled to realize the same migration distance, such that the flicker is similarly generated in the black particle 263.

As described above, in the common oscillation driving of the electrophoresis display device 1 of this embodiment, it is possible to change a duty ratio of a cycle of the potential VCOM input to the common electrode 25. Therefore, even when the migration speeds (writing time) of the white particle 262 and the black particle 263 inside the electrophoresis element 26 in the electrophoresis display device 1 are different, the migration distances of the white particle 262 and the black particle 263 in one cycle period of the potential VCOM are the same, such that even when the migration speed difference of the particle is not considered in handling, it is possible to control each writing. In other words, it is possible to allow the migration speeds of the white particle 262 and the black particle 263 to be the same by setting the duty ratio of the potential VCOM as the above-described this embodiment. As a result, it is possible to make a user of the electrophoresis display device 1 perceive as if the black color and the white color are concurrently written and it is possible to realize an optimal display capable of reducing a decrease in reliability due to deficiency or excessiveness in the writing to the pixel 2.

In addition, in the common oscillation driving of the electrophoresis display device 1 of this embodiment, it is possible to control the writing in a manner where the migration speeds of the white particle 262 and the black particle 263 are the same in appearance, such that it is possible to more correctly control the grayscale of an image displayed on the electrophoresis display device 1.

Here, a grayscale control of a display image in the electrophoresis display device will be described. FIGS. 7A to 7D show views schematically illustrating an example of an image display in the electrophoresis display device 1 of this embodiment and an electrophoresis display device of the related art. Here, it will be considered with respect to a case where the pixel B performing the black display and the pixel W performing the white display are controlled and an intermediate gray of the white and the black is displayed. To display gray, it is assumed that the pixel B and the pixel W are concurrently driven. In addition, it is assumed that the migration speed of the black particle is slower than that of the white particle.

Figure 7A:
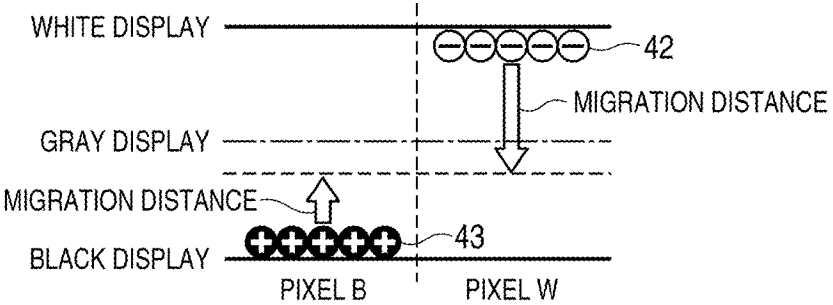
FIGS. 7A to 7D are views schematically illustrating examples of an image display in the electrophoresis display device of the embodiment and an electrophoresis display device of the related art.

In the electrophoresis display device of the related art, there is a case where the migration speeds of the white particle and the black particle in the electrophoresis element are different, such that as shown in FIG. 7A, the migration distances of the white particle and the black particle become different due to a difference of the migration speeds of the white particle and the black particles in the electrophoresis element, regardless of a case a display of the same grayscale is desired. Therefore, the pixel B and the pixel W have a grayscale of a different gray, respectively. In FIG. 7A, a display becomes darker than a grayscale of a target gray.

Figure 7B:
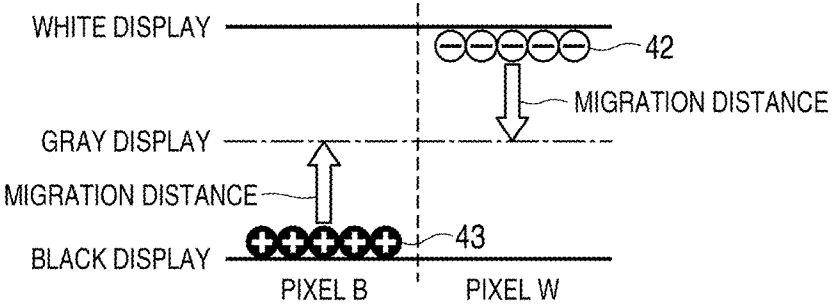

In the electrophoresis display device 1 of this embodiment, it is possible to control the migration speeds of the white particle 262 and the black particle 263 to be the same in appearance or in handling, such that as shown in FIG. 7B, it is possible to make the pixel B and the pixel W have the grayscale of the same gray.

In addition, it is considered to display a plurality of grayscales. For example, a display of 4 grayscales including "black", "dark gray (dense gray, DG)", "light gray (weak gray, LG)" and "white" can be considered.

Figure 7C:
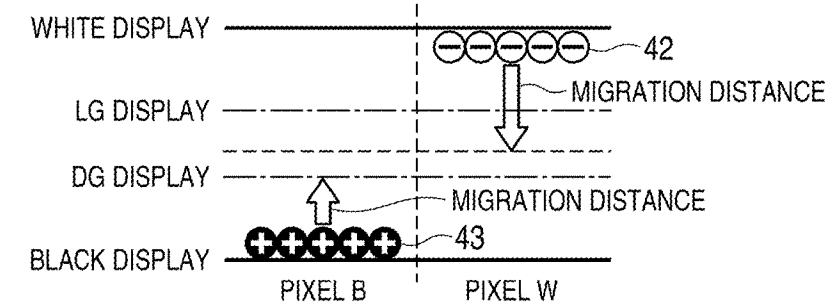

In the electrophoresis display device of the related art, since the migration speed of the white particle and the black particle in the electrophoresis element may be different, such that as shown in FIG. 7C, a grayscale difference between "dark gray (DG)", "light gray (LG)" becomes small. In FIG. 7C, it closes to the dark gray (DG) rather than a target "light gray (LG)". In addition, in a case where the difference in the migration speeds of the white particle and the black particle in the electrophoresis element is large, a display of the pixel B rewritten from "black" to "dark gray (DG)" becomes darker than a display of the pixel W written from "white" to "light gray (LG)" and thereby a display grayscale is inverted.

Figure 7D:
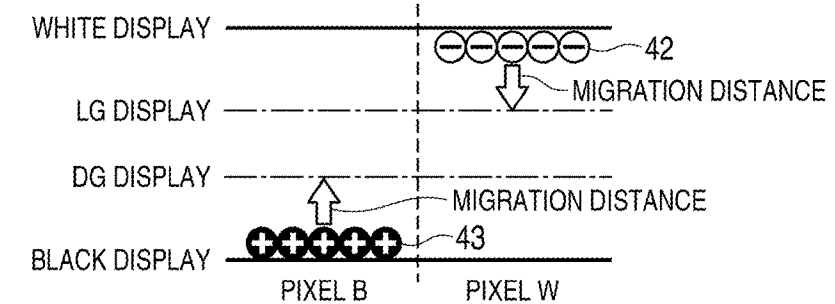

In the electrophoresis display device 1 of this embodiment, it is possible to control the migration speeds of the white particle 262 and the black particle 263 to be the same in appearance or in handling, such that as shown in FIG. 7D, it is possible to more correctly control the display grayscale of the electrophoresis display device 1, from "black" to "dark gray (DG)" in a case of the pixel B, and from "white" to "light gray (LG)" in a case of the pixel W.

In addition, in the common oscillation driving of the electrophoresis display device 1 of this embodiment, it is possible to control the migration speeds of the white particle 262 and the black particle 263 to be the same in appearance or in handling, such that it is possible to concurrently control the plurality of grayscales of an image displayed in the electrophoresis display device 1. Therefore, when the grayscale control is performed, the migration distances of the white particle and the black particle can be controlled with the same image data, such that the number of writings of the image data to the pixel can be decreased. As a result, the power consumption of the electrophoresis display device can be reduced.

Figures 1, 2, 3, 8A, 8B, 8C:
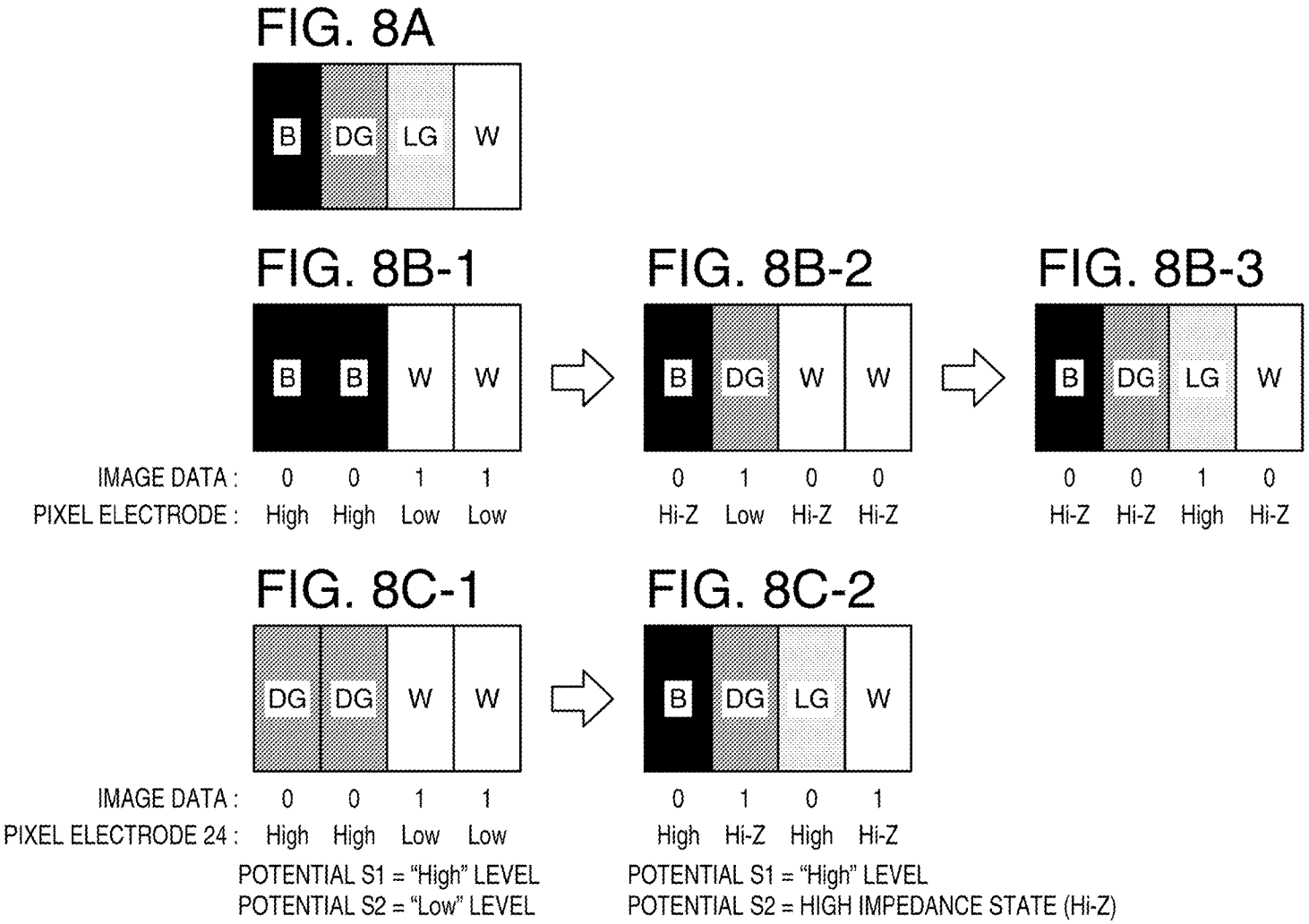

Here, description will be given with respect to image data in the grayscale control of a display image of the electrophoresis display device. FIGS. 8A to 8C-2 show views schematically illustrating an example of a pixel writing in the electrophoresis display device 1 of this embodiment and an electrophoresis display device of the related art. Here, as shown in FIG. 8A, it is considered that 4 pixels are controlled, respectively, and a display of 4 grayscales where a first pixel is "black (B)", a second pixel is "dark gray (DG)", a third pixel is "light gray (LG)" and a fourth pixel is "white (W)" is performed. In addition, it is assumed that each of the pixels is concurrently driven. In addition, it is assumed that the migration speed of the black particle is slower than that of the white particle.

In the electrophoresis display device of the related art, as shown in FIG. 8B-1, first, image data "0" is written to a first pixel and a second pixel, and a potential input to the pixel electrodes thereof is set to a high potential ("High" level). In addition, image data "1" is written to a third pixel and a fourth pixel and a potential input to the pixel electrodes thereof is set to a low potential ("Low" level). Therefore, the display of the first pixel and the second pixel is set to a "black (B)", and the display of the third pixel and the fourth pixel is set to a "white (W)".

Next, as shown in FIG. 8B-2, image data "0" is written to the first pixel, the third pixel, and the fourth pixel and a potential input to the pixel electrodes thereof is set to be a high impedance state (Hi-Z). In addition, image data "1" is written to the second pixel and a potential input to the pixel electrode thereof is set to a low potential ("Low" level). Therefore, the display of the first pixel, the third pixel, and the fourth pixel is maintained and the display of the second pixel is set to a "dark gray (DG)".

Finally, as shown in FIG. 8B-3, image data "0" is written to the first pixel, the second pixel and the fourth pixel and a potential input to the pixel electrode thereof is set to be a high impedance state (Hi-Z). In addition, image data "1" is written to the third pixel and a potential input to the pixel electrodes thereof is set to be a high potential ("High" level). Therefore, the display of the first pixel, the second pixel and the fourth pixel is maintained and the display of the third pixel is set to a "light gray (LG)".

As described above, in the electrophoresis display device, since the migration speed of the white particle and the black particle in the electrophoresis element may be different, it is necessary to control each of the pixels for each grayscale displayed to the pixels.

In the electrophoresis display device 1 of this embodiment, as shown in FIG. 8C-1, first, image data "0" is written to a first pixel 2 and a second pixel 2, and a potential input to the pixel electrodes 24 is set to a potential S1 ("High" level). In addition, image data "1" is written to a third pixel 2 and a fourth pixel 2 and a potential input to the pixel electrodes 24 is set to a potential S2 ("Low" level). A control is performed to set the display of the first pixel 2 and the second pixel 2 to a "dark green (DG)" and to set the display of the third pixel 2 and the fourth pixel 2 to a "white (W)".

Finally, as shown in FIG. 8C-2, image data "0" is written to the first pixel 2 and the third pixel 2 and a potential input to the pixel electrodes 24 is set to a potential S1 ("High" level). In addition, image data "1" is written to the second pixel 2 and the fourth pixel 2 and a potential input to the pixel electrodes 24 is set to a potential S2 (high impedance state (Hi-Z)). Therefore, a control is performed to set the display of the first pixel 2 to a "dark (B)" and to set the display of the third pixel 2 to a "light gray (LG)".

In addition, the grayscale control in the electrophoresis display device 1 of this embodiment can be performed by controlling the number of cycles of the potential VCOM input to the common electrode 25 by the common oscillation driving performed after the image data is written to each pixel 2. For example, with respect to a case where a white writing and a black writing to each of the pixels 2 are completed with the potential VCOM of 10 cycles, it is possible to set a state where the potential VCOM of 3 cycles is input to the common electrode 25 from a state where a black color is displayed as a display of a dark gray (DG) and to set a state where the potential VCOM of 7 cycles is input to the common electrode 25 as a display of a light gray (LG). By considering as described above, it is possible to easily calculate the cycle of the potential VCOM input to the common electrode 25 based on from a present display state to a next display state, and thereby it is possible to easily perform the control in the electrophoresis display device 1.

As described above, in the electrophoresis display device 1 of this embodiment, it is possible to control the migration speeds of the white particle 262 and the black particle 263 to be the same in appearance or in handling, such that it is possible to control the electrical migration distance of the white particle 262 and the black particle 263. Therefore, in the electrophoresis display device 1, it is not necessary to control the pixels for each grayscale displayed by the pixels, respectively, and it is possible to concurrently control the pixels 2 in which the electrical migration distance of the white particle 262 and the black particle 263 are the same. Therefore, it is possible to decrease power consumption at the time of writing the image data to the pixel 2, which occupies a large fraction of power consumption of the electrophoresis display device 1.

Electronic Apparatus

Figure 9A:
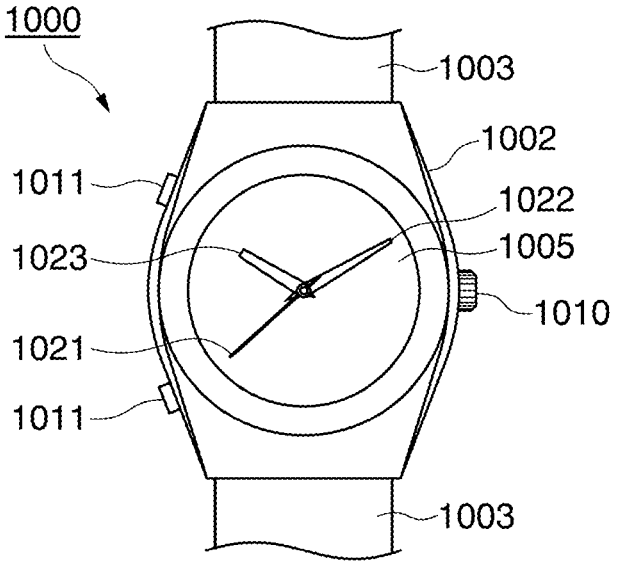
FIGS. 9A to 9C are examples of an electronic apparatus adopting the electrophoresis display device of the embodiment.
Figure 9B:
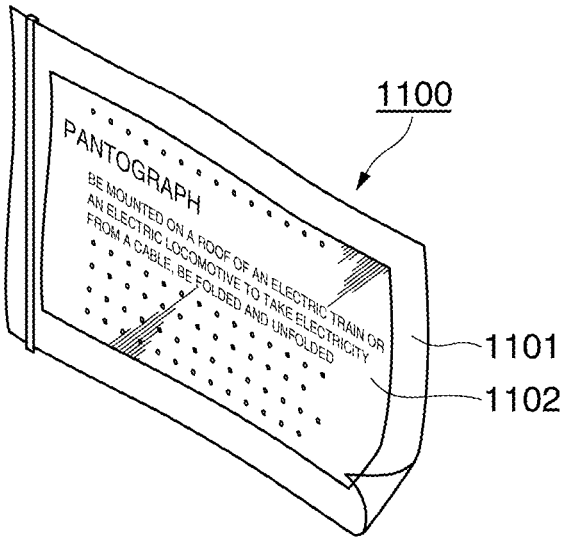
Figure 9C:
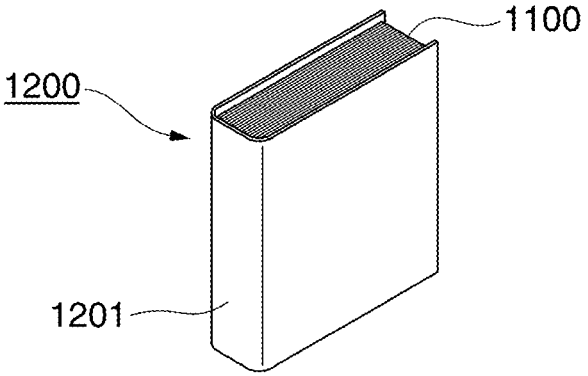

Next, description will be given with respect to a case the electrophoresis display device according to the invention is applied to an electronic apparatus. FIGS. 9A to 9C show an example of the electronic apparatus to which the electrophoresis display device 1 of this embodiment is applied.

FIG. 9A shows a front view of a watch 1000 that is an example of the electronic apparatus. The watch 1000 includes a watch case 1002 and a pair of bands 1003 connected to the watch case 1002.

A display unit 1005 including the electrophoresis display device according to the invention, a second hand 1021, a minute hand 1022 and an hour hand 1023 are provided in a front surface side of the watch case 1002. A winding crown 1010 as an operation unit and an operation button 1011 are provided in a side surface of the watch case 1002. The winding crown 1010 is connected to a winding stem (not shown) arranged inside the watch case to be freely pushed or drawn in multi-stages (for example two stages) and to be rotatable together with the winding stem in an integrated manner.

The display unit 1005 can displays an image serving as a background, a character string such as data and hour, or the second hand, the minute hand, and the hour hand by using the driving method of the electrophoresis display device according to the invention.

The watch 1000 includes the electrophoresis display device according to the invention as the display unit 1005, such that it is possible to make rewrites of a display be perceived as if they are concurrently performed and thereby it is possible to allow the watch 1000 to have an optimal display property.

FIG. 9B shows a perspective view illustrating a configuration of an electronic piece of paper 1100. The electronic piece of paper 1100 includes a main body 1101 that has a flexible property and is made of a rewritable sheet having a texture and flexibility similarly to paper in the related art, and a display unit 1102 configured by the electrophoresis display device according to the invention. In the electronic paper 1100, an optimal rewrite may be performed by the driving method of the electrophoresis display device according to the invention.

FIG. 9C shows a perspective view illustrating an electronic note 1200 that is an example of the electronic apparatus. The electronic note 1200 includes plural sheets of electronic paper 1100 that are bound up, which is shown in FIG. 9B, and a cover 1201 covering the bound up plural sheets of electronic paper 1100. The cover 1201 has, for example, a display data input unit (not shown) that inputs display data transmitted from an external device. Therefore, according to the display data, it is possible to change or update display content in a state where the plural sheets of electronic paper are bound-up as it is.

When the electronic paper 1100 and the electronic note 1200 are provided with the electrophoresis display device according to the invention, it is possible to allow rewrites of a display to be recognized as if they are concurrently performed and thereby it is possible to allow the electronic paper 1100 and the electronic note 1200 to have an optimal display property.

In addition, the electronic apparatuses shown in FIGS. 9A to 9C are illustrative only and do not limit a technical scope of the invention. For example, the electrophoresis display device according to the invention may be applied to a display region of an electronic apparatus such as a cellular phone and a portable audio apparatus other than the electronic paper 1100 and the electronic note 1200.

Therefore, it is possible to make rewrites of a display be perceived as if they are concurrently performed and thereby it is possible to allow the electronic apparatus to have an optimal display property.

As described above, according to the embodiment for implementing the invention, it is possible to change a duty ratio of a cycle of a potential applied to the common electrode of the pixel, in consideration of a characteristic of a migration speed of the electrophoresis particle. Therefore, even when the migration speed of the electrophoresis particles is different for each of the electrophoresis particles, the migration speeds of all of the electrophoresis particles are made to have the same migration speed characteristic in appearance or in handling, and thereby it is possible to perform a common oscillation driving of the electrophoresis display device. As a result, it is possible to realize the electrophoresis display device capable of making a user of the electrophoresis display device recognize as if each color displayed by the electrophoresis display device is concurrently written, and it is possible to realize an optimal display capable of reducing a decrease in reliability due to deficiency or excessiveness in the writing to a specific pixel.

According to the embodiment for implementing the invention, the migration speeds of all of the electrophoresis particles are made to have the same migration speed characteristic and thereby it is possible to perform a common oscillation driving of the electrophoresis display device, such that it is possible to more correctly control the grayscale of a displayed image, compared to the electrophoresis display device of the related art. In addition, it is possible to concurrently control the electrophoresis particles that display different grayscales, such that the number of writings of the image data to the pixel can be decreased compared to the electrophoresis display device of the related art. As a result, the power consumption of the electrophoresis display device can be reduced.

In addition, in the embodiment, the description is given with respect to a case where the white particles 262 are charged with a negative polarity (minus: −) and the black particles 263 are charged with a positive polarity (plus: +), but the invention is not limited to the embodiment for implementing the invention, and a case where the white particles 262 and the black particles 263 have polarity opposite to the above-described case, that is, the white particles 262 are charged with a positive polarity (plus: +) and the black particles 263 are charged with a negative polarity (minus: −) may be considered similarly to the embodiment.

In addition, in this embodiment, the description is given with respect to a case where the migration speed of the black particles 263 is slower than that of the white particle 262, but the invention is not limited to the embodiment for implementing the invention, and a case where the migration speed of the white particles 262 is slower than that of the black white particle 263 or a case where the times taken until the writing is completed become different may be considered similarly to the embodiment.

In addition, in the embodiment, the description is given with respect to an electrophoresis display device 1 of so-called monochrome display where two kinds of state of a white display state and a black display state by using the white particles 262 and the black particles 263 or a gray (dark gray (DG): dense gray and light gray (LG): weak gray) that is an intermediate grayscale of the white and the black are displayed. However, the invention is not limited to the embodiment for implementing the invention, and the driving method of the invention may be also applied with respect to an electrophoresis display device that substitutes pigments of a red color, a green color, a blue color, or the like for the pigments used for the white particles 262 and the black particles 263, and thereby can display a red color, a green color, a blue color, or the like.

In addition, in the embodiment, the description is given with respect to a case where either the potential S1 of the pixel control line 13 or the potential S2 of the pixel control line 14 is input to the pixel electrode 24, and the potential state of the pixel electrode 24 in the pixel 2 is concurrently set to two states. However, the invention is not limited to the embodiment for implementing the invention, and the driving method of the invention may be applied to a pixel where the potential state of the pixel electrode of the pixel can be concurrently set to a plurality of states such as a low potential ("Low" level), a high potential ("High" level), a high impedance state (Hi-Z), the same phase as that of the potential VCOM, and an opposite phase to that of the potential VCOM.

In addition, in the embodiment, the description is given with respect to a case where the common oscillation driving of the invention is applied to an active matrix type electrophoresis display device 1. However, the method of driving the electrophoresis display device according to the invention is not limited to the embodiment for implementing the invention, and the driving method according to the invention may be applied to another type of electrophoresis display device as long as the electrophoresis display device can perform the common oscillation driving.

For example, the common oscillation driving according to the invention may be applied to an electrophoresis display device having a so-called 5 transistors-type pixel structure where the pixel 2 does not include the switch circuit 23 and the pixel electrode 24 is connected to an output terminal N2 of the latch circuit 22, or a so-called segment type electrophoresis display device having a so-called one transistor and one capacitor type pixel structure where a capacitor is provided instead of the latch circuit 22 and the switch circuit 23 or a configuration where the pixel electrode of each of the pixels is directly driven by a driving circuit.

Hereinbefore, the embodiment of the invention is described with reference to drawings, but detailed configurations are not limited to the embodiment and may include various changes made without departing the scope of the invention.

The entire disclosure of Japanese Patent Application No. 2010-100019, filed Apr. 23, 2010 is expressly incorporated by reference herein.

What is claimed is:

1. A method of driving an electrophoresis display device including a display unit having a plurality of pixel electrodes, a common electrode opposite to the plurality of pixel electrodes, and first electrophoresis particles and second electrophoresis particles that are disposed between the plurality of pixel electrodes and the common electrode, the first electrophoresis particles being charged with a first polarity and the second electrophoresis particles being charged with a second polarity, the method comprising:

applying a first potential or a second potential to each of the plurality of pixel electrodes during a display rewrite period, and applying the first potential or the second potential, which are periodically switched a plurality of times during the application of the first potential or the second potential to each of the plurality of pixel electrodes, to the common electrode during the display rewrite period, wherein:

a migration speed of the first electrophoresis particles is slower than a migration speed of the second electrophoresis particles, applying the first potential to the common electrode moves the first electrophoresis particles to a common electrode side and moves the second electrophoresis particles to a pixel electrode side, applying the second potential to the common electrode moves the second electrophoresis particles to the common electrode side and moves the first electrophoresis particles to the pixel electrode side, when the first potential and the second potential are periodically applied to the common electrode, the application of the first potential for a first application time duration and the application of the second potential for a second application time duration shorter than the first application time duration are repeatedly performed during the display rewrite period, and the first application time duration and the second application time duration are set such that a distance over which the first electrophoresis particles electrically migrate during the display rewrite period according to a potential difference between the first potential and the second potential is the same as a distance over which the second electrophoresis particles electrically migrate during the display rewrite period according to the potential difference between the first potential and the second potential.

2. The method according to claim 1, wherein the first application time duration and the second application time duration are set such that a time duration obtained by adding the first application time duration and second application time duration is 50 ms or less.

3. An electrophoresis display device comprising:

a display unit having a plurality of pixel electrodes, a common electrode opposite to the plurality of pixel electrodes, and first electrophoresis particles and second electrophoresis particles that are disposed between the plurality of pixel electrodes and the common electrode, the first electrophoresis particles being charged with a first polarity and the second electrophoresis particles being charged with a second polarity;

a driving circuit that supplies a plurality of potentials to the plurality of pixel electrodes and the common electrode; and a control unit that controls the driving circuit, wherein:

the driving circuit is controlled by the control unit such that a first potential or a second potential is applied to each of the plurality of pixel electrodes during a display rewrite period, and the first potential or the second potential, which are periodically switched a plurality of times during the application of the first potential or the second potential to each of the plurality of pixel electrodes, is applied to the common electrode during the display rewrite period, a migration speed of the first electrophoresis particles is slower than a migration speed of the second electrophoresis particles, applying the first potential to the common electrode moves the first electrophoresis particles to a common electrode side and moves the second electrophoresis particles to a pixel electrode side, applying the second potential to the common electrode moves the second electrophoresis particles to the common electrode side and moves the first electrophoresis particles to the pixel electrode side, when the first potential and the second potential are periodically applied to the common electrode, the driving circuit is controlled by the control unit such that the application of the first potential for a first application time duration and the application of the second potential for a second application time duration shorter than the first application time duration are repeatedly performed during the display rewrite period, and the first application time duration and the second application time duration are set such that a distance over which the first electrophoresis particles electrically migrate during the display rewrite period according to a potential difference between the first potential and the second potential is the same as a distance over which the second electrophoresis particles electrically migrate during the display rewrite period according to the potential difference between the first potential and the second potential.

4. An electronic apparatus comprising an electrophoresis display device according to claim 3.

5. The method according to claim 1, wherein applying the first potential or the second potential to each of the plurality of pixel electrodes during the display rewrite period further comprises applying the first potential to a first plurality of pixel electrodes and applying the second potential to a second plurality of pixel electrodes during the display rewrite period.

6. A method of driving an electrophoresis display device including a display unit having a plurality of pixel electrodes, a common electrode opposite to the plurality of pixel electrodes, and first electrophoresis particles and second electrophoresis particles that are disposed between the plurality of pixel electrodes and the common electrode, the first electrophoresis particles being charged with a first polarity and the second electrophoresis particles being charged with a second polarity, the method comprising:

applying a first potential or a second potential to each of the plurality of pixel electrodes during a display rewrite period, and applying the first potential or the second potential, which are periodically switched a plurality of times during the application of the first potential or the second potential to each of the plurality of pixel electrodes, to the common electrode during the display rewrite period, wherein:

a migration speed of the first electrophoresis particles is slower than a migration speed of the second electrophoresis particles, applying the first potential to the common electrode moves the first electrophoresis particles to a common electrode side and moves the second electrophoresis particles to a pixel electrode side, applying the second potential to the common electrode moves the second electrophoresis particles to the common electrode side and moves the first electrophoresis particles to the pixel electrode side, when the first potential and the second potential are periodically applied to the common electrode, the application of the first potential for a first application time duration and the application of the second potential for a second application time duration shorter than the first application time duration are repeatedly performed during the display rewrite period, and the first application time duration and the second application time duration are set such that a time duration obtained by adding the first application time duration and second application time duration is 50 ms or less.

* * * * *